US009650854B2

(12) United States Patent
Devarajan et al.

(10) Patent No.: US 9,650,854 B2
(45) Date of Patent: May 16, 2017

(54) PACKOFF FOR LINER DEPLOYMENT ASSEMBLY

(71) Applicant: Weatherford/Lamb, Inc., Houston, TX (US)

(72) Inventors: Kannan Devarajan, Abu Dhabi (AE); Muhammad Saleem Pervez, Dubai (AE); George Givens, Spring, TX (US); Alexis Takotue, Dubai (AE); Mujeer Ahmed Mohammed, Abu Dhabi (AE)

(73) Assignee: Weatherford Technology Holdings, LLC, Houston, TX (US)

( * ) Notice: Subject to any disclaimer, the term of this patent is extended or adjusted under 35 U.S.C. 154(b) by 886 days.

(21) Appl. No.: 13/903,103

(22) Filed: May 28, 2013

(65) Prior Publication Data

US 2014/0352944 A1 Dec. 4, 2014

(51) Int. Cl.

| | |
|---|---|
| ***E21B 23/06*** | (2006.01) |
| ***E21B 23/00*** | (2006.01) |
| ***E21B 43/10*** | (2006.01) |
| ***E21B 23/02*** | (2006.01) |
| ***E21B 33/13*** | (2006.01) |

(52) U.S. Cl.

CPC ..... *E21B 23/06* (2013.01); *E21B 23/00* (2013.01); *E21B 23/02* (2013.01); *E21B 33/13* (2013.01); *E21B 43/10* (2013.01)

(58) Field of Classification Search

CPC ..... E21B 23/06; E21B 23/00; E21B 23/02; E21B 23/03; E21B 23/01; E21B 33/13; E21B 43/10; E21B 33/14; E21B 33/143; E21B 33/16; E21B 23/10

See application file for complete search history.

(56) References Cited

U.S. PATENT DOCUMENTS 4,281,711 A * 8/1981 Braddick ..... E21B 43/10 166/118
4,406,324 A * 9/1983 Baugh ..... E21B 23/02 166/125

(Continued)

FOREIGN PATENT DOCUMENTS

WO 02/097234 A1 12/2002
WO 2012/112825 A2 8/2012

OTHER PUBLICATIONS

EPO Extended European Search Report dated Feb. 5, 2015, for European Application No. 14169639.3.

(Continued)

*Primary Examiner* — Wei Wang
(74) *Attorney, Agent, or Firm* — Patterson & Sheridan, LLP

(57) ABSTRACT

A packoff for hanging a liner string from a tubular string cemented in a wellbore includes: a tubular body having an outer groove and an inner groove; an inner seal assembly disposed in the inner groove; an outer seal assembly disposed in the outer groove; a cap connected to an upper end of the body for retaining the seal assemblies; a plurality dogs disposed in respective openings formed through a wall of the body; and a lock sleeve. The lock sleeve is: disposed in the body, longitudinally movable relative to the body, and has a cam profile formed in an outer surface thereof for extending the dogs.

16 Claims, 8 Drawing Sheets

(56) References Cited

U.S. PATENT DOCUMENTS

| | | | | |
|---|---|---|---|---|
| 4,423,782 | A * | 1/1984 | Bowyer | E21B 33/1294 166/188 |
| 4,765,402 | A * | 8/1988 | Smith, Jr. | E21B 23/02 166/115 |
| 5,086,843 | A | 2/1992 | Mims et al. | |
| 5,086,844 | A | 2/1992 | Mims et al. | |
| 5,170,847 | A | 12/1992 | Mims et al. | |
| 5,174,375 | A | 12/1992 | Mims et al. | |
| 5,628,366 | A | 5/1997 | Telfer | |
| 6,053,244 | A | 4/2000 | Dybevik et al. | |
| 6,065,536 | A * | 5/2000 | Gudmestad | E21B 17/06 166/208 |
| 6,241,018 | B1 | 6/2001 | Eriksen | |
| 6,408,945 | B1 | 6/2002 | Telfer | |
| 7,114,573 | B2 | 10/2006 | Hirth et al. | |
| 8,118,106 | B2 | 2/2012 | Wiens et al. | |
| 2003/0127222 | A1 | 7/2003 | Marcin et al. | |
| 2004/0221984 | A1 | 11/2004 | Cram | |
| 2011/0108266 | A1 | 5/2011 | Smith et al. | |
| 2012/0055667 | A1* | 3/2012 | Ingram | E21B 33/1208 166/65.1 |
| 2012/0205092 | A1* | 8/2012 | Givens | E21B 33/1208 166/118 |

OTHER PUBLICATIONS

Weatherford—"HNG Hydraulic-Release Running Tool" brochure, 2006, 1 page.
Weatherford—"Weatherford's Liner Systems Hang Tough" brochure, 2008, 16 pages.
Weatherford—"WellMaster All-in-One Deepwater System" brochure, date unknown, 1 page.

* cited by examiner

PACKOFF FOR LINER DEPLOYMENT ASSEMBLY

BACKGROUND OF THE DISCLOSURE

Field of the Disclosure

The present disclosure generally relates to a packoff for a liner deployment assembly.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

SUMMARY OF THE DISCLOSURE

In one embodiment, a packoff for hanging a liner string from a tubular string cemented in a wellbore includes: a tubular body having an outer groove and an inner groove; an inner seal assembly disposed in the inner groove; an outer seal assembly disposed in the outer groove; a cap connected to an upper end of the body for retaining the seal assemblies; a plurality dogs disposed in respective openings formed through a wall of the body; and a lock sleeve. The lock sleeve is: disposed in the body, longitudinally movable relative to the body, and has a cam profile formed in an outer surface thereof for extending the dogs.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
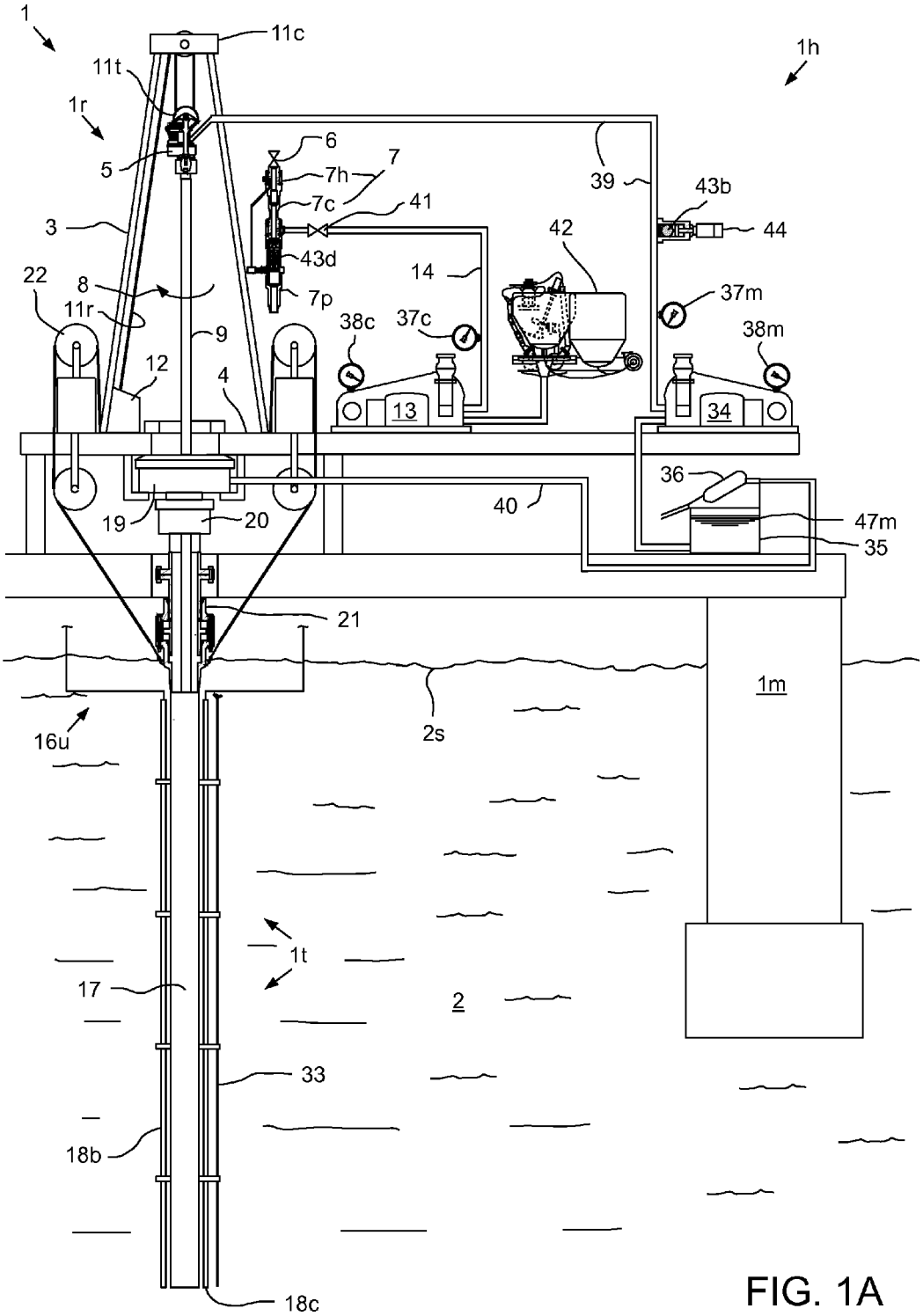
FIGS. 1A-1C illustrate a drilling system in a liner deployment mode, according to one embodiment of this disclosure.
Figure 1B:
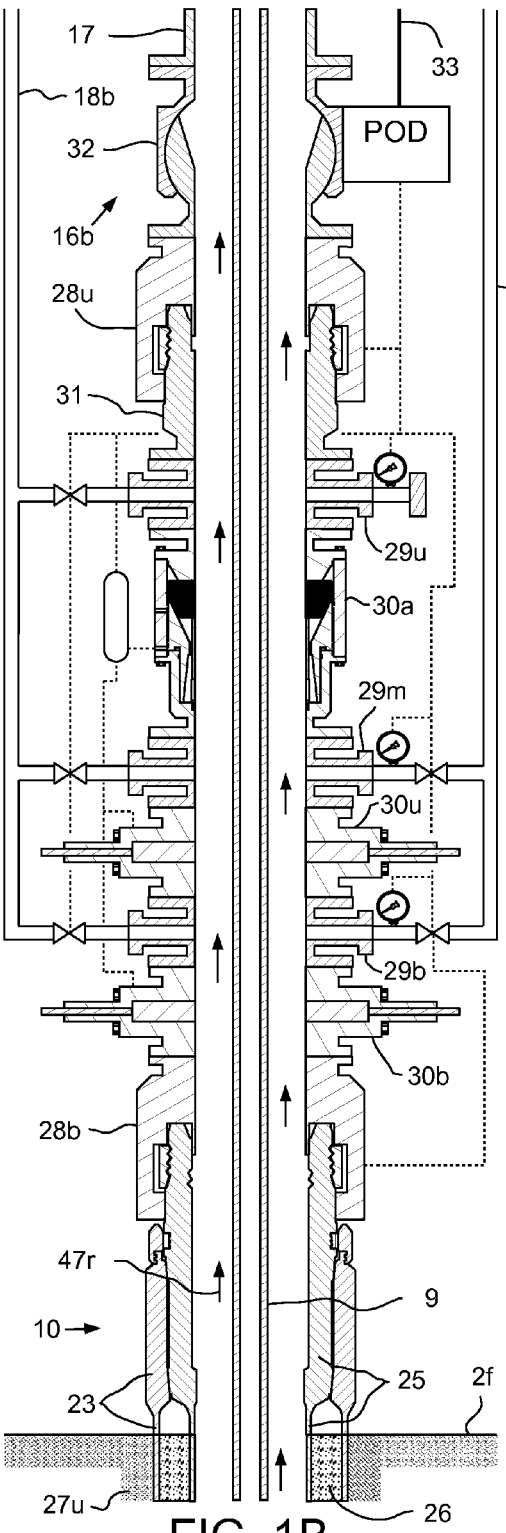
Figure 1C:
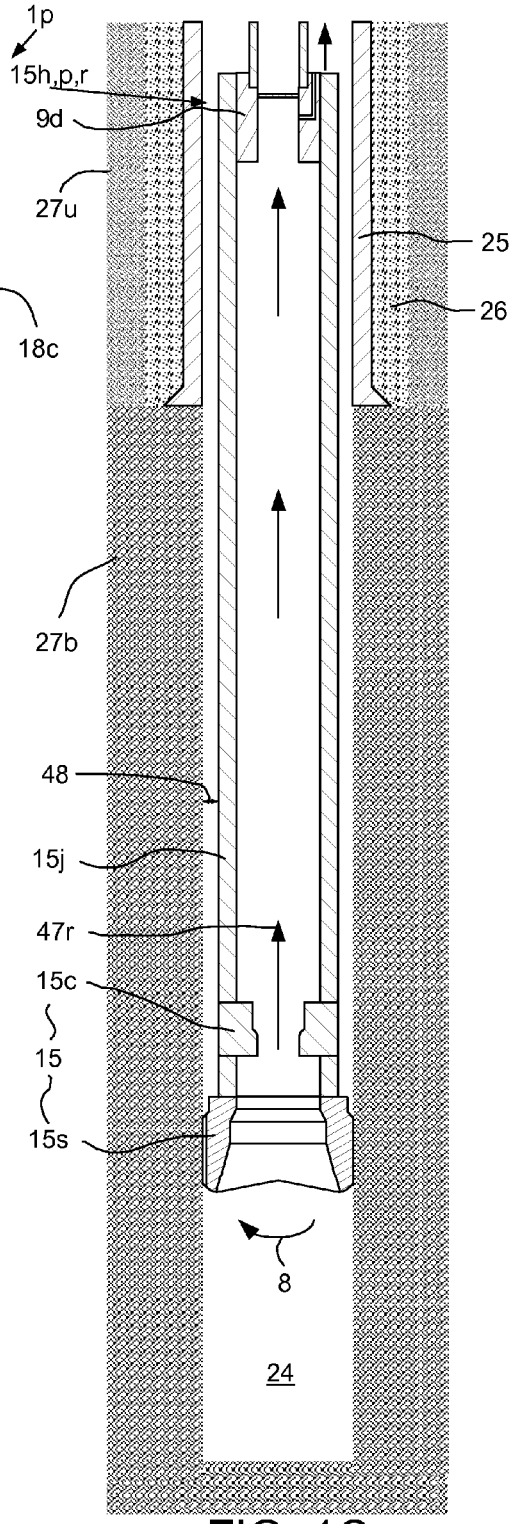

FIGS. 1A-1C illustrate a drilling system in a liner deployment mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, an isolation valve 6, a cementing swivel 7, and a hoist. The top drive 5 may include a motor for rotating 8 the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The quill may be torsionally driven by the top drive motor and supported from the frame by bearings. The top drive may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

Figures 2A, 2B, 2C, 2D:
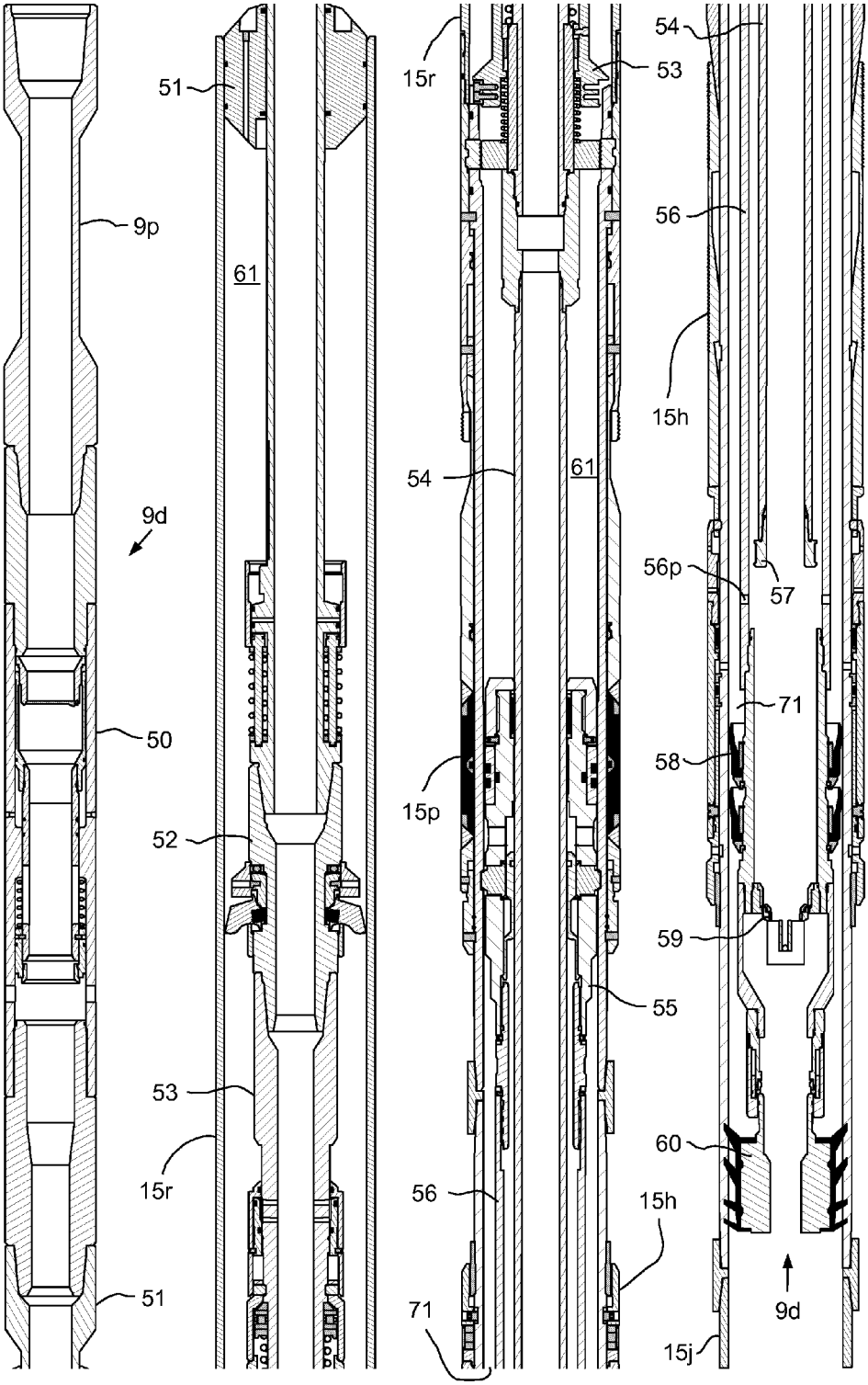
FIGS. 2A-2D illustrate a liner deployment assembly (LDA) of the drilling system.

In the deployment mode, an upper end of the workstring 9 may be connected to the top drive quill, such as by threaded couplings. The workstring 9 may include a liner deployment assembly (LDA) 9*d* and a deployment string, such as joints of drill pipe 9*p* (FIG. 2A) connected together, such as by threaded couplings. An upper end of the LDA 9*d* may be connected a lower end of the drill pipe 9*p*, such as by a threaded connection. The LDA 9*d* may also be connected to a liner string 15. The liner string 15 may include a polished bore receptacle (PBR) 15*r*, a packer 15*p*, a liner hanger 15*h*, joints of liner 15*j*, a float collar 15*c*, and a reamer shoe 15*s*. The liner string members may each be connected together, such as by threaded couplings. The reamer shoe 15*s* may be rotated 8 by the top drive 5 via the workstring 9.

Alternatively, the liner string may include a drillable drill bit (not shown) instead of the reamer shoe 15*s* and the liner string 15 may be drilled into the lower formation, thereby extending the wellbore while deploying the liner string.

Once liner deployment has concluded, the isolation valve 6 may be connected to a quill of the top drive 5 and an upper end of the cementing head 7, such as by threaded couplings. An upper end of the workstring 9 may be connected to a lower end of the cementing head 7, such as by threaded couplings. The cementing head 7 may include an actuator swivel 7*h*, a cementing swivel 7*c*, and one or more plug launchers 7*p*. The cementing swivel 7*c* may include a housing torsionally connected to the derrick 3, such as by bars, wire rope, or a bracket (not shown). The torsional connection may accommodate longitudinal movement of the cementing swivel 7*c* relative to the derrick 3. The cementing swivel 7*c* may further include a mandrel and bearings for supporting the housing from the mandrel while accommodating rotation 8 of the mandrel. The mandrel may also be connected to the isolation valve 6. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. Each seal assembly may include one or more stacks of V-shaped seal rings, such as opposing stacks, disposed between the mandrel and the housing and straddling the inlet-port interface. Alternatively, the seal assembly may include rotary seals, such as mechanical face seals.

The actuator swivel 7*h* may be similar to the cementing swivel 7*c* except that the housing inlet may be in fluid communication with a passage formed through the mandrel. The mandrel passage may extend to an outlet of the mandrel for connection to a hydraulic conduit for operating a hydraulic actuator of the launcher 7*p*. The actuator swivel 7*h* may be in fluid communication with a hydraulic power unit (HPU).

The launcher 7*p* may include a housing, a diverter, a canister, a latch, and the actuator. The housing may be tubular and may have a bore therethrough and a coupling formed at each longitudinal end thereof, such as threaded couplings. To facilitate assembly, the housing may include two or more sections (three shown) connected together, such as by a threaded connection. The housing may also serve as the cementing swivel housing. The housing may further have a landing shoulder formed in an inner surface thereof. The canister and diverter may each be disposed in the housing bore. The diverter may be connected to the housing, such as by a threaded connection. The canister may be longitudinally movable relative to the housing. The canister may be tubular and have ribs formed along and around an outer surface thereof. Bypass passages may be formed between the ribs. The canister may further have a landing shoulder formed in a lower end thereof corresponding to the housing landing shoulder. The diverter may be operable to deflect fluid received from a cement line 14 away from a bore of the canister and toward the bypass passages. A cementing plug 43*d* may be disposed in the canister bore.

The latch may include a body, a plunger, and a shaft. The body may be connected to a lug formed in an outer surface of the launcher housing, such as by a threaded connection. The plunger may be longitudinally movable relative to the body and radially movable relative to the housing between a capture position and a release position. The plunger may be moved between the positions by interaction, such as a jackscrew, with the shaft. The shaft may be longitudinally connected to and rotatable relative to the body. The actuator may be a hydraulic motor operable to rotate the shaft relative to the body.

Alternatively, the actuator swivel and launcher actuator may be pneumatic or electric. Alternatively, the actuator may be linear, such as a piston and cylinder. Alternatively, the actuator may be electric or pneumatic. Alternatively, the actuator may be manual, such as a handwheel.

In operation, the HPU may be operated to supply hydraulic fluid to the actuator via the actuator swivel 7*h*. The actuator may then move the plunger to the release position (not shown). The canister and cementing plug 43*d* may then move downward relative to the housing until the landing shoulders engage. Engagement of the landing shoulders may close the canister bypass passages, thereby forcing fluid to flow into the canister bore. The fluid may then propel the cementing plug 43*d* from the canister bore into a lower bore of the housing and onward through the workstring 9.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPS 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extend between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14; mud line 39, return line 40, a cement mixer 42, and a plug launcher 44. The drilling fluid 47*m* may include a base liquid. The base liquid may be refined or synthetic oil, water, brine, or a water/oil emulsion. The drilling fluid 47*m* may further include solids dissolved or suspended in the base liquid, such as organophilic clay, lignite, and/or asphalt, thereby forming a mud.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The plug launcher 44 and the pressure gauge 37*m* may be assembled as part of the mud line 39. An upper end of the cement line 14 may be connected to the cementing swivel inlet and a lower end of the cement line may be connected to an outlet of the cement pump 13. A shutoff valve 41 and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The plug launcher 44 may include a housing, a plunger, an actuator, and a pump down plug, such as a ball 43*b*, loaded therein. The ball 43*b* may be disposed in the plunger for selective release and pumping downhole through the drill pipe 9*p* to the LDA 9*d*. The plunger may be movable relative to the respective launcher housing between a captured position and a release position. The plunger may be moved between the positions by the actuator. The actuator may be hydraulic, such as a piston and cylinder assembly.

Alternatively, the actuator may be electric or pneumatic. Alternatively, the actuator may be manual, such as a handwheel. Alternatively, the ball may be manually launched by breaking a connection in the respective line. Alternatively, the plug launcher may be part of the cementing head.

The workstring 9 may be rotated 8 by the top drive 5 and lowered by the traveling block 11*t*, thereby reaming the liner string 15 into the lower formation 27*b*. Drilling fluid in the wellbore 24 may be displaced through courses of the reamer shoe 15*s*, where the fluid may circulate cuttings away from the shoe and return the cuttings into a bore of the liner string 15. The returns 47*r* (drilling fluid plus cuttings) may flow up the liner bore and into a bore of the LDA 9*d*. The returns 47*r* may flow up the LDA bore and to a diverter valve 50 (FIG. 2A) thereof. The returns 47*r* may be diverted into an annulus 48 formed between the workstring 9/liner string 15 and the casing string 25/wellbore 24 by the diverter valve 50. The returns 47*r* may exit the wellbore 24 and flow into an annulus formed between the riser 17 and the drill pipe 9*p* via an annulus of the LMRP 16*b*, BOP stack, and wellhead 10. The returns 47*r* may exit the riser and enter the return line 40 via an annulus of the UMRP 16*u* and the diverter 19. The returns 47*r* may flow through the return line 40 and into the shale shaker inlet. The returns 47*r* may be processed by the shale shaker 36 to remove the cuttings.

FIGS. 2A-2D illustrate the liner deployment assembly LDA 9*d*. The LDA 9*d* may include a diverter valve 50, a junk bonnet 51, a setting tool 52, running tool 53, a stinger 54, an upper packoff 55, a spacer 56, a release 57, a lower packoff 58, a catcher 59, and a cementing plug 60.

An upper end of the diverter valve 50 may be connected to a lower end the drill pipe 9*p* and a lower end of the diverter valve 50 may be connected to an upper end of the junk bonnet 51, such as by threaded couplings. A lower end of the junk bonnet 51 may be connected to an upper end of the setting tool 52 and a lower end of the setting tool may be connected to an upper end of the running tool 53, such as by threaded couplings. The running tool 53 may also be fastened to the packer 15*p*. An upper end of the stinger 54 may be connected to a lower end of the running tool 53 and a lower end of the stringer may be connected to the release 57, such as by threaded couplings. The stinger 54 may extend through the upper packoff 55. The upper packoff 55 may be fastened to the packer 15*p*. An upper end of the spacer 56 may be connected to a lower end of the upper packoff 55, such as by threaded couplings. An upper end of the lower packoff 58 may be connected to a lower end of the spacer 56, such as by threaded couplings. An upper end of the catcher 59 may be connected to a lower end of the lower packoff 58, such as by threaded couplings. The cementing plug 60 may be fastened to a lower end of the catcher 59.

The diverter valve 50 may include a housing, a bore valve, and a port valve. The diverter housing may include two or more tubular sections (three shown) connected to each other, such as by threaded couplings. The diverter housing may have threaded couplings formed at each longitudinal end thereof for connection to the drill pipe 9*p* at an upper end thereof and the junk bonnet 51 at a lower end thereof. The bore valve may be disposed in the housing. The bore valve may include a body and a valve member, such as a flapper, pivotally connected to the body and biased toward a closed position, such as by a torsion spring. The flapper may be oriented to allow downward fluid flow from the drill pipe 9*p* through the rest of the LDA 9*d* and prevent reverse upward flow from the LDA to the drill pipe 9*p*. Closure of the flapper may isolate an upper portion of a bore of the diverter valve from a lower portion thereof. Although not shown, the body may have a fill orifice formed through a wall thereof and bypassing the flapper.

Figures 4A, 4B, 4C, 4D:
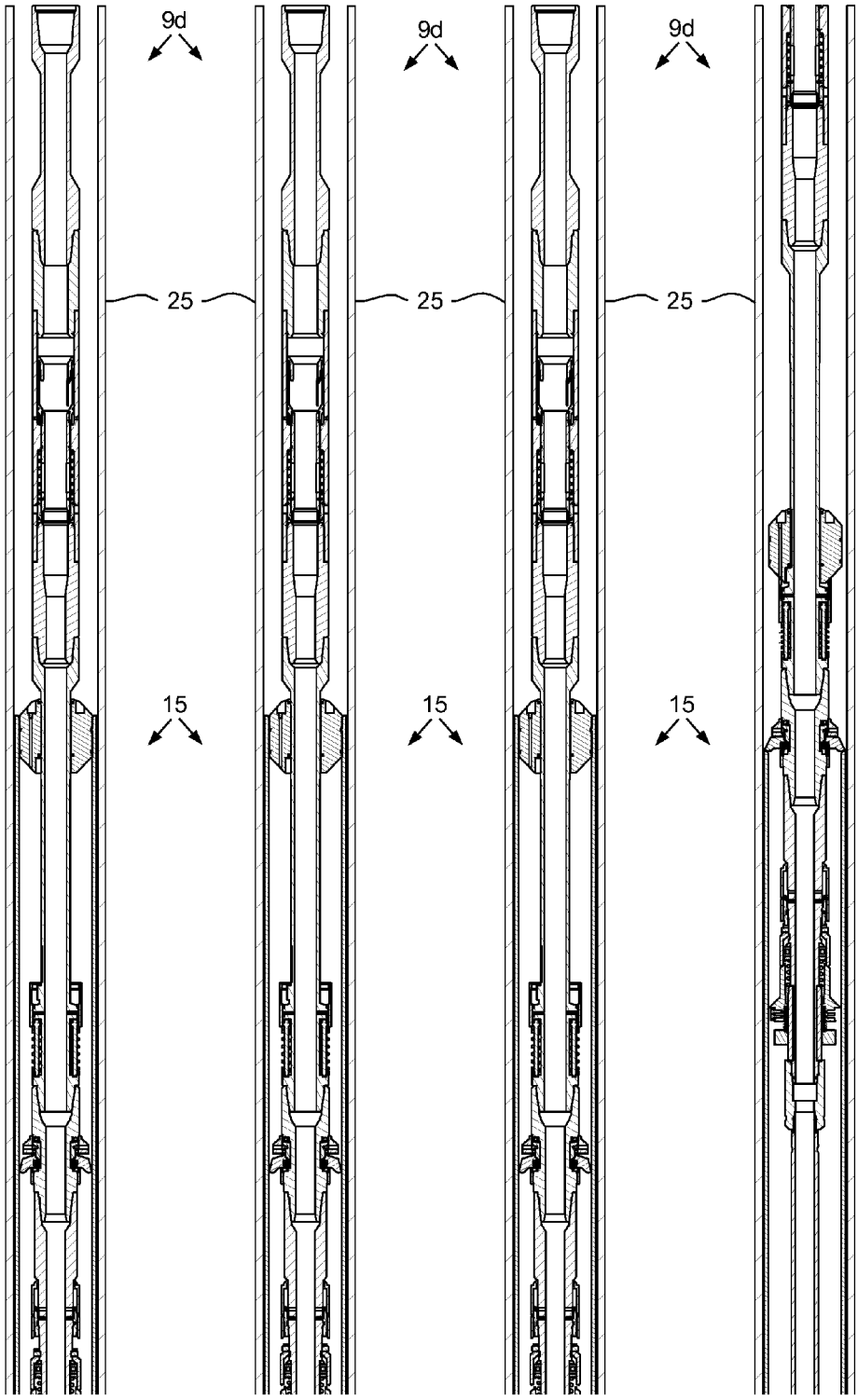
FIGS. 4A-4D illustrate operation of an upper portion of the LDA.
Figures 5A, 5B, 5C, 5D:
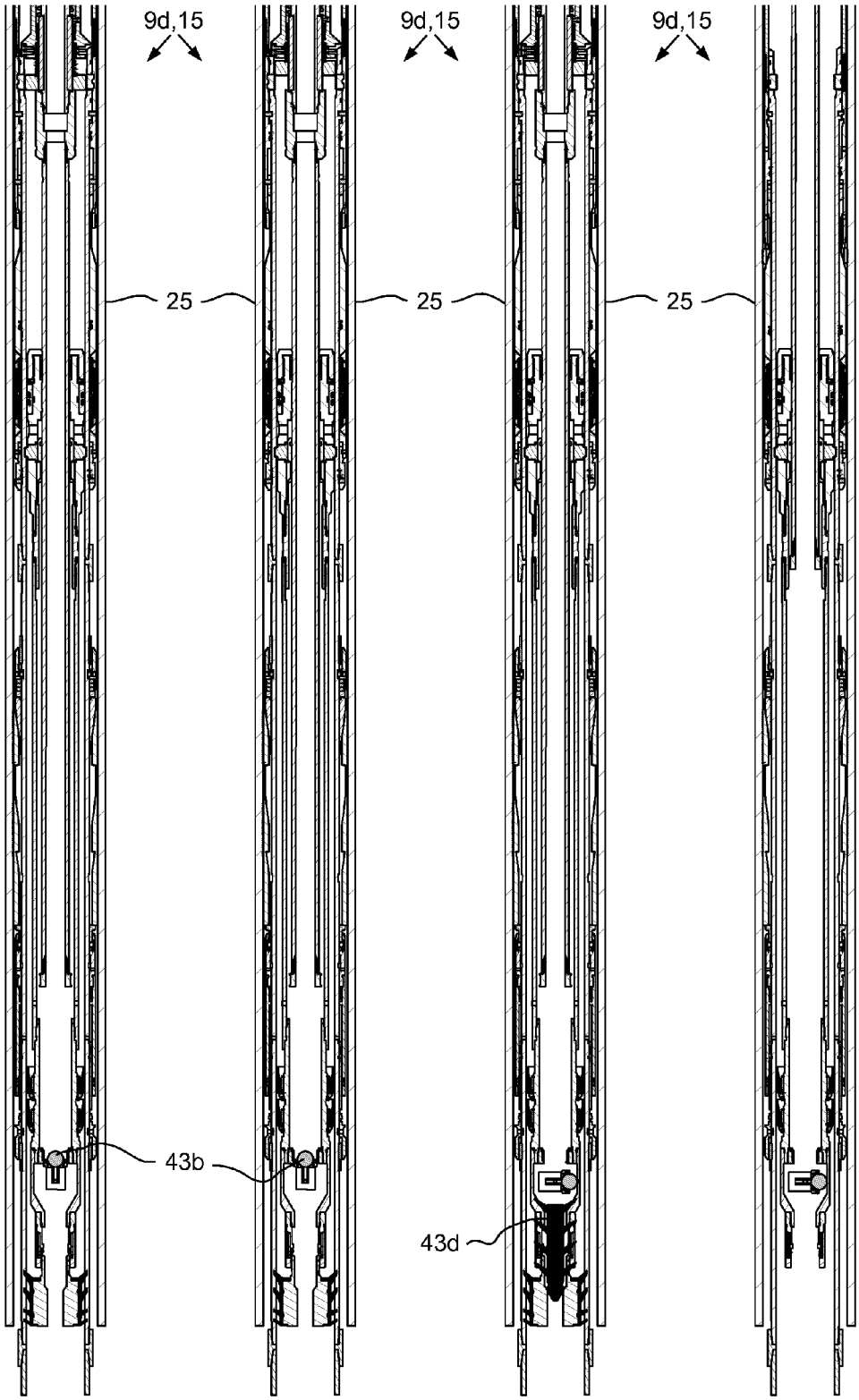
FIGS. 5A-5D illustrate operation of a lower portion of the LDA.

The diverter port valve may include a sleeve and a biasing member, such as a compression spring. The sleeve may include two or more sections (four shown) connected to each other, such as by threaded couplings and/or fasteners. An upper section of the sleeve may be connected to a lower end of the bore valve body, such as by threaded couplings. Various interfaces between the sleeve and the housing and between the housing sections may be isolated by seals. The sleeve may be disposed in the housing and longitudinally movable relative thereto between an upper position (shown) and a lower position (FIG. 4A). The sleeve may be stopped in the lower position against an upper end of the lower housing section and in the upper position by the bore valve body engaging a lower end of the upper housing section. The mid housing section may have one or more flow ports and one or more equalization ports formed through a wall thereof. One of the sleeve sections may have one or more equalization slots formed therethrough providing fluid communication between a spring chamber formed in an inner surface of the mid housing section and the lower bore portion of the diverter valve 50.

One of the sleeve sections may cover the housing flow ports when the sleeve is in the lower position, thereby closing the housing flow ports and the sleeve section may be clear of the flow ports when the sleeve is in the upper position, thereby opening the flow ports. In operation, surge pressure of the returns 47*r* generated by deployment of the LDA 9*d* and liner string 15 into the wellbore may be exerted on a lower face of the closed flapper. The surge pressure may push the flapper upward, thereby also pulling the sleeve upward against the compression spring and opening the housing flow ports. The surging returns 47*r* may then be diverted through the open flow ports by the closed flapper. Once the liner string 15 has been deployed, dissipation of the surge pressure may allow the spring to return the sleeve to the lower position.

The junk bonnet 51 may include a piston, a mandrel, and a release valve. Although shown as one piece, the mandrel may include two or more sections connected to each other, such as by threaded couplings and/or fasteners. The mandrel may have threaded couplings formed at each longitudinal end thereof for connection to the diverter valve 50 at an upper end thereof and the setting tool 52 at a lower end thereof.

The piston may be an annular member having a bore formed therethrough. The mandrel may extend through the piston bore and the piston may be longitudinally movable relative thereto subject to entrapment between an upper shoulder of the mandrel and the release valve. The piston may carry one or more (two shown) outer seals and one or more (two shown) inner seals. Although not shown, the junk bonnet 51 may further include a split seal gland carrying each piston inner seal and a retainer for connecting the each seal gland to the piston, such as by a threaded connection. The inner seals may isolate an interface between the piston and the mandrel.

The piston may also be disposed in a bore of the PBR 15*r* adjacent an upper end thereof and be longitudinally movable relative thereto. The outer seals may isolate an interface between the piston and the PBR 15*r*, thereby forming an upper end of a buffer chamber 61. A lower end of the buffer chamber 61 may be formed by a sealed interface between the upper packoff 55 and the packer 15*p*. The buffer chamber 61 may be filled with a hydraulic fluid (not shown), such as fresh water or oil, such that the piston may be hydraulically locked in place. The buffer chamber 61 may prevent infiltration of debris from the wellbore 24 from obstructing operation of the LDA 9*d*. The piston may include a fill passage extending longitudinally therethrough closed by a plug. The mandrel may include a bypass groove formed in and along an outer surface thereof. The bypass groove may create a leak path through the piston inner seals during removal of the LDA 9*d* from the liner string 15 (FIG. 4D) to release the hydraulic lock.

The release valve may include a shoulder formed in an outer surface of the mandrel, a closure member, such as a sleeve, and one or more biasing members, such as compression springs. Each spring may be carried on a rod and trapped between a stationary washer connected to the rod and a washer slidable along the rod. Each rod may be disposed in a pocket formed in an outer surface of the mandrel. The sleeve may have an inner lip trapped formed at a lower end thereof and extending into the pockets. The lower end may also be disposed against the slidable washer. The valve shoulder may have one or more one or more radial ports formed therethrough. The valve shoulder may carry a pair of seals straddling the radial ports and engaged with the valve sleeve, thereby isolating the mandrel bore from the buffer chamber 61.

The piston may have a torsion profile formed in a lower end thereof and the valve shoulder may have a complementary torsion profile formed in an upper end thereof. The piston may further have reamer blades formed in an upper surface thereof. The torsion profiles may mate during removal of the LDA 9*d* from the liner string 15, thereby torsionally connecting the piston to the mandrel. The piston may then be rotated during removal to back ream debris accumulated adjacent an upper end of the PBR 15*r*. The piston lower end may also seat on the valve sleeve during removal. Should the bypass groove be clogged, pulling of the drill pipe 9*p* may cause the valve sleeve to be pushed downward relative to the mandrel and against the springs to open the radial ports, thereby releasing the hydraulic lock.

Alternatively, the piston may include two elongate hemi-annular segments connected together by fasteners and having gaskets clamped between mating faces of the segments to inhibit end-to-end fluid leakage. Alternatively, the piston may have a radial bypass port formed therethrough at a location between the upper and lower inner seals and the bypass groove may create the leak path through the lower inner seal to the bypass port. Alternatively, the valve sleeve may be fastened to the mandrel by one or more shearable fasteners.

The setting tool 52 may include a body, a plurality of fasteners, such as dogs, and a rotor. Although shown as one piece, the body may include two or more sections connected to each other, such as by threaded couplings and/or fasteners. The body may have threaded couplings formed at each longitudinal end thereof for connection to the junk bonnet 51 at an upper end thereof and the running tool 53 at a lower end thereof. The body may have a recess formed in an outer surface thereof for receiving the rotor. The rotor may include a thrust ring, a thrust bearing, and a guide ring. The guide ring and thrust bearing may be disposed in the recess. The thrust bearing may have an inner race torsionally connected to the body, such as by press fit, an outer race torsionally connected to the thrust ring, such as by press fit, and a rolling element disposed between the races. The thrust ring may be connected to the guide ring, such as by one or more threaded fasteners. An upper portion of a pocket may be formed between the thrust ring and the guide ring. The setting tool 52 may further include a retainer ring connected to the body adjacent to the recess, such as by one or more threaded fasteners. A lower portion of the pocket may be formed between the body and the retainer ring. The dogs may be disposed in the pocket and spaced around the pocket.

Each dog may be movable relative to the rotor and the body between a retracted position (shown) and an extended position (FIG. 4D). Each dog may be urged toward the extended position by a biasing member, such as a compression spring. Each dog may have an upper lip, a lower lip, and an opening. An inner end of each spring may be disposed against an outer surface of the guide ring and an outer portion of each spring may be received in the respective dog opening. The upper lip of each dog may be trapped between the thrust ring and the guide ring and the lower lip of each dog may be trapped between the retainer ring and the body. Each dog may also be trapped between a lower end of the thrust ring and an upper end of the retainer ring. Each dog may also be torsionally connected to the rotor, such as by a pivot fastener (not shown) received by the respective dog and the guide ring.

The running tool 53 may include a body, a lock, a clutch, and a latch. The body may include two or more tubular sections (two shown) connected to each other, such as by threaded couplings. The body may have threaded couplings formed at each longitudinal end thereof for connection to the setting tool 52 at an upper end thereof and the stinger 54 at a lower end thereof. The latch may longitudinally and torsionally connect the liner string 15 to an upper portion of the LDA 9*d*. The latch may include a thrust cap having one or more torsional fasteners, such as keys, and a longitudinal fastener, such as a floating nut. The keys may mate with a torsional profile formed in an upper end of the packer 15*p* and the floating nut may be screwed into threaded dogs of the packer. The lock may be disposed on the body to prevent premature release of the latch from the liner string 15. The clutch may selectively torsionally connect the thrust cap to the body.

The lock may include a piston, a plug, one or more fasteners, such as dogs, and a sleeve. The plug may be connected to an outer surface of the body, such as by threaded couplings. The plug may carry an inner seal and an outer seal. The inner seal may isolate an interface formed between the plug and the body and the outer seal may isolate an interface formed between the plug and the piston. The piston may have an upper portion disposed along an outer surface of the body and an enlarged lower portion disposed along an outer surface of the plug. The piston may carry an inner seal in the upper portion for isolating an interface formed between the body and the piston. The piston may be fastened to the body, such as by one or more shearable fasteners. An actuation chamber may be formed between the piston, plug, and body. The body may have one or more ports formed through a wall thereof providing fluid communication between the chamber and a bore of the body.

The lock sleeve may have an upper portion disposed along an outer surface of the body and extending into the piston lower portion and an enlarged lower portion. The lock sleeve may have one or more openings formed therethrough and spaced around the sleeve to receive a respective dog therein. Each dog may extend into a groove formed in an outer surface of the body, thereby fastening the lock sleeve to the body. A thrust bearing may be disposed in the lock sleeve lower portion and against a shoulder formed in an outer surface of the body. The thrust bearing may be biased against the body shoulder by a compression spring.

The body may have a torsional profile, such as one or more keyways formed in an outer surface thereof adjacent to a lower end of the upper body section. A key may be disposed in each of the keyways. A lower end of the compression spring may bear against the keyways.

The thrust cap may be linked to the lock sleeve, such as by a lap joint. The latch keys may be connected to the thrust cap, such as by one or more threaded fasteners. A shoulder may be formed in an inner surface of the thrust cap dividing an upper enlarged portion from a lower enlarged portion of the thrust cap. The shoulder and enlarged lower portion may receive an upper portion of a biasing member, such as a compression spring. A lower end of the compression spring may be received by a shoulder formed in an upper end of the float nut.

The float nut may be urged against a shoulder formed by an upper end of the lower housing section by the compression spring. The float nut may have a thread formed in an outer surface thereof. The thread may be opposite-handed, such as left handed, relative to the rest of the threads of the workstring 9. The float nut may be torsionally connected to the body by having one or more keyways formed along an inner surface thereof and receiving the keys, thereby providing upward freedom of the float nut relative to the body while maintaining torsional connection.

The clutch may include a gear and a lead nut. The gear may be formed by one or more teeth connected to the thrust cap, such as by a threaded fastener. The teeth may mesh with the keys, thereby torsionally connecting the thrust cap to the body. The lead nut may be disposed in a threaded passage formed in an inner surface of the thrust cap upper enlarged portion and have a threaded outer surface meshed with the thrust cap thread, thereby longitudinally connecting the lead nut and thrust cap while providing torsional freedom therebetween. The lead nut may be torsionally connected to the body by having one or more keyways formed along an inner surface thereof and receiving the keys, thereby providing longitudinal freedom of the lead nut relative to the body while maintaining torsional connection. The lead nut and thrust cap threads may have a finer pitch, opposite hand, and be greater in number than the float nut and packer dogs threads to facilitate greater longitudinal displacement per rotation.

In operation, once the liner hanger 15*h* has been set, the lock may be released by supplying sufficient fluid pressure through the body ports. Weight may then be set down on the liner string, thereby pushing the thrust cap upward and disengaging the clutch gear. The workstring may then be rotated to cause the lead nut to travel down the threaded passage of the thrust cap while the float nut travels upward relative to the threaded dogs of the packer. The float nut may disengage from the threaded dogs before the lead nut bottoms out in the threaded passage. Rotation may continue to bottom out the lead nut, thereby restoring torsional connection between the thrust cap and the body.

Alternatively, the running tool may be replaced by a hydraulically released running tool. The hydraulically released running tool may include a piston, a shearable stop, a torsion sleeve, a longitudinal fastener, such as a collet, a cap, a case, a spring, a body, and a catch. The collet may have a plurality of fingers each having a lug formed at a bottom thereof. The finger lugs may engage a complementary portion of the packer 15*p*, thereby longitudinally connecting the running tool to the liner string 15. The torsion sleeve may have keys for engaging the torsion profile formed in the packer 15*p*. The collet, case, and cap may be longitudinally movable relative to the body subject to limitation by the stop. The piston may be fastened to the body by one or more shearable fasteners and fluidly operable to release the collet fingers when actuated by a threshold release pressure. In operation, fluid pressure may be increased to push the piston and fracture the shearable fasteners, thereby releasing the piston. The piston may then move upward toward the collet until the piston abuts the collet and fractures the stop. The latch piston may continue upward movement while carrying the collet, case, and cap upward until a bottom of the torsion sleeve abuts the fingers, thereby pushing the fingers radially inward. The catch may be a split ring biased radially inward and disposed between the collet and the case. The body may include a recess formed in an outer surface thereof. During upward movement of the piston, the catch may align and enter the recess, thereby preventing reengagement of the fingers. Movement of the piston may continue until the cap abuts a stop shoulder of the body, thereby ensuring complete disengagement of the fingers.

An upper end of an actuation chamber 71 may be formed by the sealed interface between the upper packoff 55 and the packer 15*p*. A lower end of the actuation chamber 71 may be formed by the sealed interface between the lower packoff 58 and the liner hanger 15*h*. The actuation chamber 71 may be in fluid communication with the LDA bore (above the ball seat 59) via one or more ports 56*p* formed through a wall of the spacer 56.

Figure 3A:
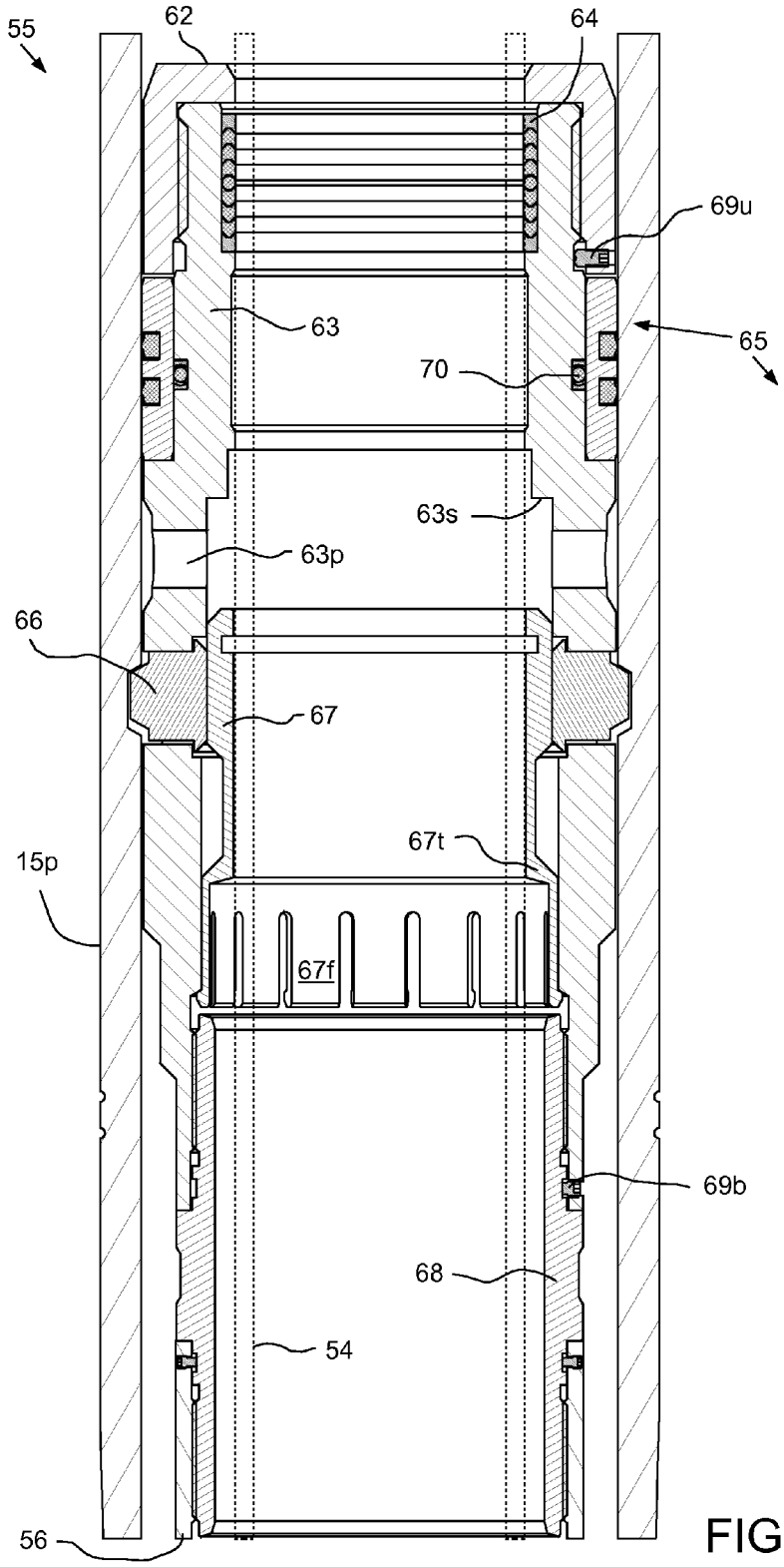
FIG. 3A illustrates an upper packoff of the LDA in an engaged position.
Figure 3B:
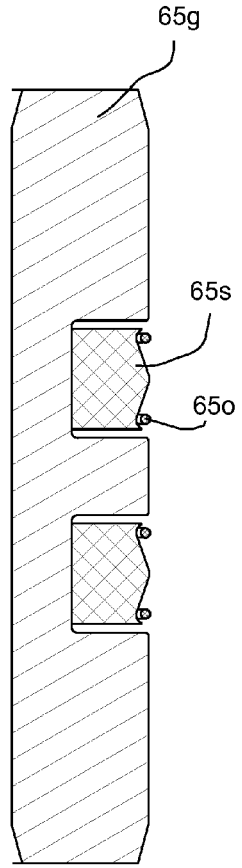
FIG. 3B illustrates an outer seal assembly of the upper packoff.
Figure 3C:
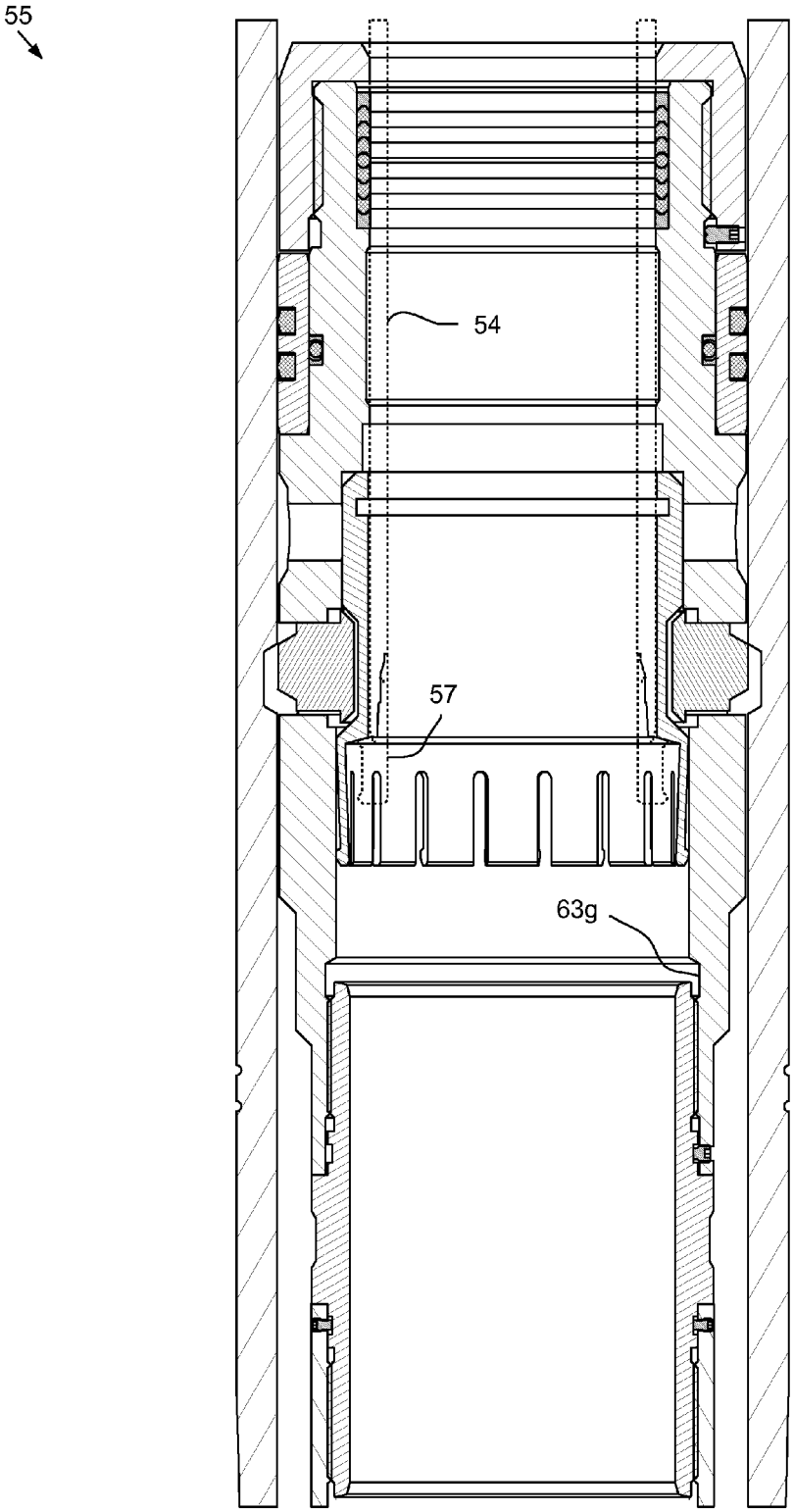
FIG. 3C illustrates the upper packoff in a disengaged position.

FIG. 3A illustrates the upper packoff 55 in an engaged position. FIG. 3B illustrates an outer seal assembly of the upper packoff 55. FIG. 3C illustrates the upper packoff 55 in a disengaged position. The upper packoff 55 may include a cap 62, a body 63, an inner seal assembly, such as seal stack 64, the outer seal assembly, such as cartridge 65, one or more fasteners, such as dogs 66, a lock sleeve 67, an adapter 68, and a detent. The upper packoff 55 may be tubular and have a bore formed therethrough. The stinger 54 may be received through the upper packoff bore and an upper end of the spacer 56 may be fastened to a lower end of the upper packoff 55. The upper packoff 55 may be fastened to the packer 15*p* by engagement of the dogs 66 with an inner surface of the packer. Except for seals, the upper packoff 55 may be made from a metal or alloy, such as steel, stainless steel, or nickel based alloy.

The cap 62 may be connected to an upper end of the body 63, such as by threaded couplings. The coupling of the cap 62 may have a threaded socket formed through a wall thereof. A threaded fastener 69*u* may be screwed into the socket and extend into a groove formed in an outer surface of the body coupling, thereby securing the threaded connection between the cap and the body. The adapter 68 may be connected to a lower end of the body 63, such as by threaded couplings. The lower body coupling may have a threaded socket formed through a wall thereof. A threaded fastener 69*b* may be screwed into the socket and extend into a groove formed in an outer surface of the upper adapter coupling, thereby securing the threaded connection between the adapter 68 and the body 63. A lower end of the adapter 68 may be connected to an upper end of the spacer 56, such as by threaded couplings. The spacer coupling may have one or more threaded sockets formed through a wall thereof. A threaded fastener may be screwed into each socket and extend into a groove formed in an outer surface of the lower adapter coupling, thereby securing the threaded connection between the spacer 56 and the adapter 68*r*.

The seal stack 64 may be disposed in a groove formed in an inner surface of the body 63. The seal stack 64 may be connected to the body 63 by entrapment between a shoulder of the groove and a lower face of the cap 62. The seal stack 64 may include an upper adapter, an upper set of one or more (three shown) directional seals, a center adapter, a lower set of one or more (three shown) directional seals, and a lower adapter. Each directional seal may be a V-ring and made from an elastomer or elastomeric copolymer. The upper and lower sets of V-rings may be in opposed orientations. Each V-ring may have an inner diameter corresponding to an outer diameter of the stinger 54, such as being slightly less than the outer diameter. The upper set of V-rings may be oriented to sealingly engage an outer surface of the stinger 54 in response to pressure in the LDA bore/actuation chamber 71 being greater than pressure in the buffer chamber 61 and the lower set of V-rings may be oriented to sealingly engage an outer surface of the stinger 54 in response to pressure in the LDA bore/actuation chamber 71 being less than pressure in the buffer chamber 61. The end adapters may be made from a metal, alloy, or engineering polymer. The center adapter may be a seal, such as an o-ring and made from the V-ring material.

The cartridge 65 may be disposed in a groove formed in an outer surface of the body 63. The cartridge 65 may be connected to the body 63 by entrapment between a shoulder of the groove and a lower end of the cap 62. The cartridge 65 may include a gland 65*g* and one or more (two shown) seal assemblies. The gland 65*g* may have a groove formed in an outer surface thereof for receiving each seal assembly. Each seal assembly may include a seal, such as an S-ring 65*s*, and a pair of anti-extrusion elements, such as garter springs 65*o*. Each S-ring 65*s* may be made from an elastomer or elastomeric copolymer and each garter spring 65*o* may be made from a metal or alloy, such as steel, stainless steel, or nickel based alloy, or an engineering polymer. Each pair of garter springs 65*o* may be molded into an outer surface of the respective S-ring 65*s* with one of the pair located at an upper end thereof and the other of the pair located at a lower end thereof. The S-ring 65*s* may have a convex outer surface forming a lip at a middle thereof. Each lip may be energized to seal against an inner surface of the packer 15*p*, thereby isolating a pressure differential between the LDA bore/actuation chamber 71 and the buffer chamber 61, and each pair of garter springs 65*o* may support the respective seal lip to resist disengagement thereof.

The body 63 may also carry a seal, such as an O-ring 70, to isolate an interface formed between the body and the gland 65*g*. The O-ring may be made from an elastomer or elastomeric copolymer and be supported by backup rings. The backup rings may be made from metal, alloy, or engineering polymer.

Advantageously, the seal stack 64 and the cartridge 65 may be easily replaced by removing the cap 62.

The body 63 may have one or more (two shown) equalization ports 63*p* formed through a wall thereof located adjacently below the cartridge groove. The body may further have a stop shoulder 63*s* formed in an inner surface thereof adjacent to the equalization ports 63*p*.

The lock sleeve 67 may be disposed in a bore of the body and longitudinally movable relative thereto between a lower position (FIG. 3A) and an upper position (FIG. 3C). The lock sleeve 67 may be stopped in the upper position by engagement of an upper end thereof with the stop shoulder 63*s* and held in the lower position by the detent. The body 63 may have one or more openings formed therethrough and spaced around the body to receive a respective dog 66 therein. Each dog 66 may extend into a groove formed in the inner surface of the packer 15*p*, thereby fastening a lower portion of the LDA 9*d* to the packer 15*p*. Each dog 66 may be radially movable relative to the body 63 between an extended position (FIG. 3A) and a retracted position (FIG. 3C). Each dog 66 may be extended by interaction with a cam profile formed in an outer surface of the lock sleeve 67. Each dog 66 may have an arcuate shape to conform to the lock sleeve 67, body 63, and packer 15*p*. Each dog 66 may further have an upper lip, a lower lip, and outer lug. The lips may trap the dogs 66 between a stop profile formed in an inner surface of the body 63 adjacent to the openings 66 and the lock sleeve outer surface. Each lug may be chamfered to interact with chamfers of the packer groove to radially push the dogs 66 to the retracted position in response to longitudinal movement of the upper packoff 55 relative to the packer 15*p*.

The lock sleeve 67 may further have a taper 67*t* formed in a wall thereof and collet fingers 67*f* extending from the taper to a lower end thereof. The detent may include the collet fingers 67*f* and a complementary groove 63*g* formed in an inner surface of the body 63. The detent may resist movement of the lock sleeve 67 from the lower position to the upper position. Each finger 67*f* may have a lug formed at a lower end thereof. The fingers 67*f* may be cantilevered from the taper 67*t* and have a stiffness urging the lugs toward an engaged position with the groove 63*g*. Each lug may be chamfered to interact with a chamfer of the body groove 63*g* to radially push the fingers 67*f* to the retracted position in response to upward force exerted on the lock sleeve 67 by engagement of the release 57 with an inner surface of the taper 67*t*. The lock sleeve 67 may further have a groove formed in an inner surface thereof adjacent to an upper end thereof for receiving an installation tool (not shown).

Returning to FIG. 2D, the lower packoff 58 may include a body and one or more (two shown) seal assemblies. The body may have threaded couplings formed at each longitudinal end thereof for connection to the spacer 56 at an upper end thereof and the catcher 59 at a lower end thereof. Each seal assembly may include a directional seal, such as cup seal, an inner seal, a gland, and a washer. The inner seal may be disposed in an interface formed between the cup seal and the body. The gland may be fastened to the body, such as a by a snap ring. The cup seal may be connected to the gland, such as molding or press fit. An outer diameter of the cup seal may correspond to an inner diameter of the liner hanger 15*h*, such as being slightly greater than the inner diameter. The cup seal may oriented to sealingly engage the liner hanger inner surface in response to pressure in the LDA bore being greater than pressure in the liner string bore (below the liner hanger).

The catcher 59 may include a body and a seat fastened to the body, such as by one or more shearable fasteners. The seat may also be linked to the body by a cam and follower. Once the ball 43*b* is caught, the seat may be released from the body by a threshold pressure exerted on the ball. Once released, the seat and ball 43*b* may swing relative to the body into a capture chamber, thereby reopening the LDA bore.

FIGS. 4A-4D illustrate operation of an upper portion of the LDA 9*d*. FIGS. 5A-5D illustrate operation of a lower portion of the LDA 9*d*. Once the liner string 15 has been advanced into the wellbore 24 by the workstring 9 to a desired deployment depth, conditioner (not shown) may be circulated by the cement pump 13 through the valve 41 or by the mud pump 34 via the top drive 5 to prepare for pumping of the cement slurry 130*c*. If the mud pump is being used for conditioning, the launcher 44 may then be operated and the mud pump 34 may propel the ball 43*b* through the top drive and down the workstring 9 to the catcher 59. If the cement pump 13 is being used for conditioning, a launcher of the cement head 7 may be operated to deploy the ball 43*b*. Once the ball 43*b* lands in the catcher seat, pumping may continue to increase pressure in the LDA bore/actuation chamber 71.

Once a first threshold pressure is reached, a piston of the liner hanger 15*h* may set slips thereof against the casing 25. Pumping may continue until as second threshold pressure is reached and the running tool 53 is unlocked. Pumping may continue until a third threshold pressure is reached and the catcher seat is released from the catcher body. Weight may then be set down on the liner string 15 and the workstring 9 rotated, thereby releasing the liner string 15 from the setting tool 53. An upper portion of the workstring 9 may be raised and then lowered to confirm release of the running tool 53. The workstring 9 and liner string 15 may then be rotated 8 from surface by the top drive 5 and rotation may continue during the cementing operation. Cement slurry (not shown) may be pumped from the mixer 42 into the cementing swivel 7*c* via the valve 41 by the cement pump 13. The cement slurry may flow into the launcher 7*p* and be diverted past the dart 43*d* via the diverter and bypass passages.

Once the desired quantity of cement slurry has been pumped, the cementing dart 43*d* may be released from the launcher 7*p* by operating the actuator. Chaser fluid (not shown) may be pumped into the cementing swivel 7*c* via the valve 41 by the cement pump 13. The chaser fluid may flow into the launcher 7*p* and be forced behind the dart 43*d* by closing of the bypass passages, thereby propelling the dart into the workstring bore. Pumping of the chaser fluid by the cement pump 13 may continue until residual cement in the cement discharge conduit has been purged. Pumping of the chaser fluid may then be transferred to the mud pump 34 by closing the valve 41 and opening the valve 6. The dart 43*d* may be driven through the workstring bore by the chaser fluid until the dart lands onto the cementing plug 60, thereby closing a bore thereof. Continued pumping of the chaser fluid may exert pressure on the seated dart 43*d* until the cementing plug 60 is released from the LDA 9*d*.

Once released, the combined dart and plug 43*d*, 60 may be driven through the liner bore by the chaser fluid, thereby driving cement slurry through the float collar 15*c* and reamer shoe 15*s* into the annulus 48. Pumping of the chaser fluid may continue until the combined dart and plug 43*d*, 60 land on the collar 15*c*, thereby releasing a prop of a float valve (not shown) of the collar 15*c*. Once the combined dart and plug 43*d*, 60 have landed, pumping of the chaser fluid may be halted and workstring upper portion raised until the setting tool 52 exits the PBR 15*r*. The workstring upper portion may then be lowered until the setting tool 52 lands onto a top of the PBR 15*r*. Weight may then be exerted on the PBR 15*r* to set the packer 15*p*. Once the packer has been set, rotation 8 of the workstring 9 may be halted. The LDA 9*d* may then be raised from the liner string 15 and chaser fluid circulated to wash away excess cement slurry. The workstring 9 may then be retrieved to the MODU 1*m*.

Additionally, the cementing head 7 may further include a bottom dart and a bottom wiper may also be connected to the setting tool. The bottom dart may be launched before pumping of the cement slurry.

Figure 6:
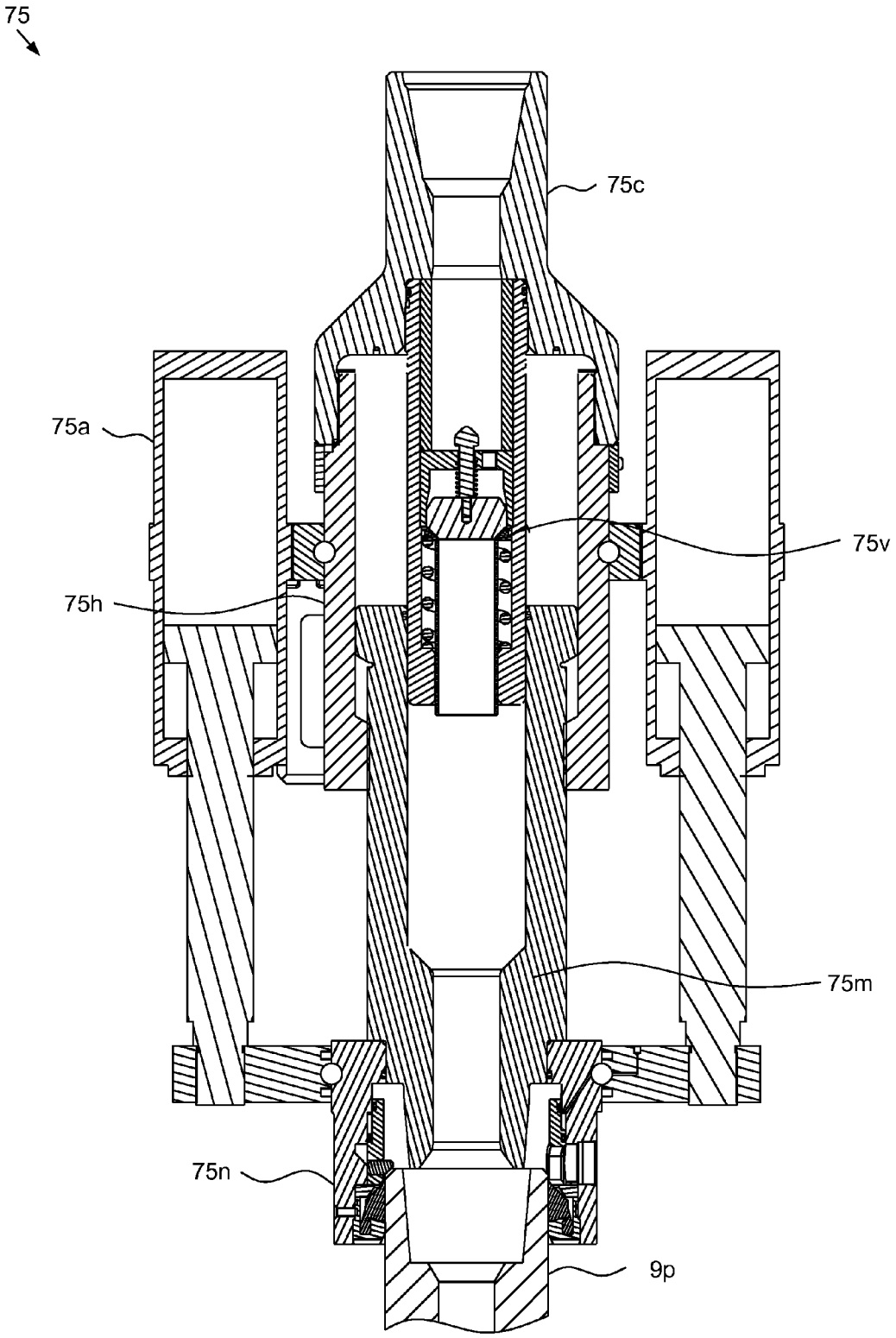
FIG. 6 illustrates a flowback tool for use with the drilling system, according to another embodiment of this disclosure.

FIG. 6 illustrates a flowback tool 75 for use with the drilling system 1, according to another embodiment of this disclosure. Alternatively, the liner string 15 may not need to be rotated during deployment and a flowback tool (not shown) may be connected to the top drive quill during liner deployment. The flowback tool 75 may include a cap 75*c*, a housing 75*h*, a mandrel 75*m*, a nose 75*n*, and an actuator 75*a*. The mandrel and the nose may be longitudinally movable relative to the housing between a retracted position and an engaged position by the actuator. The nose may sealingly engage an outer surface of the drill pipe 9*p* in the engaged position, thereby providing fluid communication between the top drive 5 and the bore of the drill pipe 9*p*.

The flowback actuator may include two or more piston and cylinder assemblies (P&Cs), an upper swivel, and a lower swivel. Each P&C may be longitudinally coupled to the housing via the upper swivel and longitudinally coupled to the nose via the lower swivel. The upper swivel may include arms for engaging bails of a link-tilt (not shown), thereby torsionally coupling the P&Cs to the bails. Each of the swivels may include one or more bearings, thereby allowing relative rotation between the P&Cs and the housing. Hydraulic conduits may extend from each of the P&Cs to the top drive manifold to provide for extension and retraction of the P&Cs. A hydraulic conduit may also extend to the lower swivel which may be in fluid communication with the nose via a port thereof.

The flowback cap may be annular and have a bore therethrough. An upper longitudinal end of the cap may include a threaded coupling, such as a box, for connection with a threaded coupling of the quill, such as a pin, thereby longitudinally and torsionally connecting the quill and the cap. The cap may taper outwardly so that a lower longitudinal end thereof may have a substantially greater diameter than the upper longitudinal end. An inner surface of the cap lower end may be threaded for receiving a threaded upper longitudinal end of the housing, thereby longitudinally connecting the cap and the housing.

The flowback housing may be tubular and have a bore formed therethrough. An outer surface of the housing may be grooved for receiving the bearings, such as ball bearings, thereby longitudinally connecting the housing and the upper swivel. A lower longitudinal end of the housing may be longitudinally splined for engaging longitudinal splines formed on an outer surface of the mandrel, thereby torsionally connecting the housing and the mandrel. The housing lower end may form a shoulder for receiving a corresponding shoulder formed at an upper longitudinal end of the mandrel, thereby longitudinally connecting the housing and the mandrel. The P&Cs may be capable of supporting weight of the nose and the mandrel and the shoulders, when engaged, may be capable of supporting weight of the workstring 9. The shoulders may engage before the P&Cs are fully extended, thereby ensuring that string weight is not transferred to the P&Cs.

A lower longitudinal end of the flowback mandrel may form a threaded coupling, such as a pin, for engaging a threaded coupling, such as a box, formed at a upper end of the drill pipe 9*p*. An outer surface of the mandrel adjacent to the lower longitudinal end may be threaded and form a shoulder for receiving a threaded inner surface and shoulder of the nose, thereby longitudinally and torsionally connecting the nose and the mandrel. One or more seals may be disposed between the mandrel and the nose, thereby isolating a seal chamber of the nose from an exterior of the flowback tool. A substantial portion of the mandrel bore may be sized to receive a a mudsaver valve (MSV) 75*v*.

The flowback nose may include a body, a piston, one or more fasteners, such as dogs, a seal retainer, a seal, a stop, and a valve. The body may be annular and have a bore therethrough. The body may include a groove formed in an outer surface for receiving bearings, such as balls. A port may be formed through the wall of the body providing fluid communication between the groove and an outer surface of the piston. The body may include one or more slots formed in an inner surface for receiving respective dogs. Each slot may have an inclined face for radially moving the dogs from a retracted position to an extended position as the piston moves longitudinally relative to the body.

The flowback nose piston may include corresponding slots formed therethrough for receiving the dogs. Each piston slot may include a lip (not shown) for abutting a respective lip (not shown) formed in each dog, thereby radially retaining the dogs in the slot. Each dog may include a tapered inner surface for engaging an end of the drill pipe 9*p* when the drill pipe is being moved longitudinally relative to the body from the locked position to the well control position, thereby longitudinally moving the piston and radially moving the dogs from the extended position to the retracted position. The body may include a groove formed in an inner surface for receiving a seal, such as an o-ring, for engagement with the mandrel.

The flowback nose body may include a vent formed through a wall thereof and in fluid communication with a seal chamber, defined by a portion of the nose bore between the seal and the mandrel seal, and the valve for safely disposing of residual fluid left in the seal chamber before disengaging the drill pipe 9*p*. The vent may be threaded for receiving a threaded coupling of the valve, thereby longitudinally and torsionally connecting the valve and the body. The body may include a recess formed at a lower longitudinal end thereof for receiving the seal retainer and the stop. One or more holes may be formed through the housing wall for receiving fasteners, such as set screws, thereby longitudinally connecting the seal retainer and the body. The body may include a profile formed therein for receiving a corresponding profile formed in an outer surface of the piston.

The flowback nose piston may be annular and have a bore formed therethrough. The piston may be disposed in the body and longitudinally movable relative thereto between a locked position and the unlocked position. The piston may include the profile on the outer surface thereof. Upper and lower seals may be disposed between the piston and the body (on piston as shown) so as to straddle the port, thereby isolating a piston chamber from the remainder of the nose. A shoulder may be formed as part of the piston profile, thereby providing a piston surface. The piston may have a port formed therethrough in alignment with the vent when the piston is in the locked position and partially aligned with the vent when the piston is in the unlocked position. The piston may abut the stop in the locked position. The nose and/or the lower longitudinal end of the mandrel may be configured so that the nose and the mandrel are biased away (i.e., upward) from the drill pipe 9*p* in the engaged position by fluid pressure from the workstring 9.

The flowback nose seal retainer may be annular and may have a substantially J-shaped cross section for receiving and retaining the seal. The seal may include a base portion having a lip for engaging a corresponding lip of the retainer and a cup portion for engaging the outer surface of the drill pipe 9*p*. An outer surface of the cup portion may be inclined for receiving fluid pressure to press the cup portion into engagement with the drill pipe 9*p*. When engaged, the cup portion may be supported by a tapered inner surface of the stop and/or the piston. The seal may be molded into the retainer or pressed therein. The stop may abut a shoulder of the recess and an upper longitudinal end of the retainer, thereby longitudinally connecting the stop and the body.

In operation, once a stand of drill pipe 9*p* is made up with the workstring 9, the workstring may be advanced into the wellbore 24. Hydraulic fluid from the top drive manifold may be injected into the nose via the lower swivel, thereby locking the piston or moving the piston into the locked position and locking the piston. Hydraulic pressure may be maintained on the piston during advancement of the workstring 9 into the wellbore 24, thereby rigidly locking the piston and the dogs. Hydraulic fluid may be then injected into the P&Cs, thereby lowering the nose and the mandrel until an outer surface of the drill pipe box engages the seal and then the dogs. Hydraulic pressure may be maintained on the P&Cs during advancement of the workstring 9 into the wellbore 24, thereby overcoming the upward bias from fluid pressure and ensuring that the dogs and seal remain engaged to the drill pipe 9*p* during advancement of the workstring 9 into the wellbore 24. Engagement of the seal with the drill pipe box may provide fluid communication between the workstring 9 and the top drive 5, thereby allowing: the drill pipe stand to be filled with drilling fluid 47*m* and/or injection of drilling fluid 47*m* through the workstring 9 during advancement thereof into the wellbore 24.

Once the workstring 9 has been advanced into the wellbore 24 and requires another stand for further advancement, a spider (not shown) may be set. The valve may be connected to a disposal line (not shown) and fluid may be bled through the vent by opening the valve. Hydraulic pressure to the P&Cs may be reversed, thereby raising the nose and the mandrel to the retracted position. Hydraulic pressure may be relieved from the piston. The link-tilt may then release the workstring 9. The top drive 5 may be moved proximate to another stand and the link-tilt operated to grab the stand. The stand may be moved into position over the workstring 9 and madeup with the workstring 9. The flowback tool may then again be operated by repeating the cycle.

While the foregoing is directed to embodiments of the present disclosure, other and further embodiments of the disclosure may be devised without departing from the basic scope thereof, and the scope of the invention is determined by the claims that follow.

The invention claimed is:

1. A packoff for hanging a liner string from a tubular string cemented in a wellbore, comprising:
- a tubular body having an outer groove and an inner groove;
- an inner seal assembly disposed in the inner groove;
- an outer seal assembly disposed in the outer groove;
- a cap connected to an upper end of the body for retaining the seal assemblies;
- a plurality of dogs disposed in respective openings formed through a wall of the body, wherein the body has one or more equalization ports formed through the wall thereof between the outer seal assembly and the openings; and
- a lock sleeve:
  - disposed in the body,
  - longitudinally movable relative to the body, and
  - having a cam profile formed in an outer surface thereof for extending the plurality of dogs.

2. The packoff of claim 1, wherein the outer seal assembly is a cartridge having:
- a gland;
- one or more S-rings disposed in respective grooves formed in an outer surface of the gland; and
- a pair of garter springs molded in an outer surface of each S-ring.

3. The packoff of claim 2, wherein the inner seal assembly comprises a seal stack having opposed V-rings.

4. The packoff of claim 2, further comprising an O-ring disposed in an interface formed between the body and the gland.

5. The packoff of claim 1, wherein:
- the lock sleeve further has collet fingers formed in a portion thereof, and
- the body has a groove formed in an inner surface thereof for receiving lugs of the collet fingers.

6. The packoff of claim 5, wherein the lock sleeve further has a taper formed in a wall thereof adjacent to the collet fingers.

7. The packoff of claim 1, further comprising an adapter connected to a lower end of the body, wherein a lower end of the adapter has a threaded coupling formed therein and a groove formed in an outer surface of the coupling for receiving an end of a fastener.

8. A liner deployment assembly (LDA), for hanging a liner string from a tubular string cemented in a wellbore, comprising:

a setting tool operable to set a packer of the liner string;

a running tool operable to longitudinally and torsionally connect the liner string to an upper portion of the LDA;

a stinger connected to the running tool;

an upper packoff of claim 1 for sealing against an inner surface of the liner string and an outer surface of the stinger and for connecting the liner string to a lower portion of the LDA; and a release connected to the stinger for disconnecting the upper packoff from the liner string.

9. The LDA of claim 8, further comprising:

a lower packoff for sealing against an inner surface of the liner string;

a spacer connecting the lower packoff to the upper packoff; and a catcher connected to the lower packoff; and a cementing plug fastened to the catcher.

10. A packoff for hanging a liner string from a tubular string cemented in a wellbore, comprising:

a tubular body having an outer groove and an inner groove;

an inner seal assembly disposed in the inner groove;

an outer seal assembly disposed in the outer groove;

a cap connected to an upper end of the body for retaining the seal assemblies;

a plurality of dogs disposed in respective openings formed through a wall of the body; and a lock sleeve:

disposed in the body, having collet fingers formed in a portion thereof, wherein the tubular body has a groove formed in an inner surface thereof for receiving lugs of the collet fingers, longitudinally movable relative to the body, and having a cam profile formed in an outer surface thereof for extending the plurality of dogs.

11. The packoff of claim 10, wherein the lock sleeve further has a taper formed in a wall thereof adjacent to the collet fingers.

12. The packoff of claim 10, wherein the outer seal assembly is a cartridge having:

a gland;

one or more S-rings disposed in respective grooves formed in an outer surface of the gland; and a pair of garter springs molded in an outer surface of each S-ring.

13. The packoff of claim 12, wherein the inner seal assembly comprises a seal stack having opposed V-rings.

14. The packoff of claim 12, further comprising an O-ring disposed in an interface formed between the body and the gland.

15. The packoff of claim 10, wherein the body has one or more equalization ports formed through the wall thereof adjacent to the outer seal assembly.

16. The packoff of claim 10, further comprising an adapter connected to a lower end of the body, wherein a lower end of the adapter has a threaded coupling formed therein and a groove formed in an outer surface of the coupling for receiving an end of a fastener.

* * * * *